US008604870B2

(12) United States Patent
Ikeda

(10) Patent No.: US 8,604,870 B2
(45) Date of Patent: Dec. 10, 2013

(54) CONSTANT-VOLTAGE CIRCUIT AND SEMICONDUCTOR DEVICE THEREOF

(75) Inventor: Kentaro Ikeda, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/215,608

(22) Filed: Aug. 23, 2011

(65) Prior Publication Data

US 2012/0200339 A1 Aug. 9, 2012

(30) Foreign Application Priority Data

Feb. 4, 2011 (JP) ..... 2011-023186

(51) Int. Cl.
*G05F 1/10* (2006.01)

(52) U.S. Cl.
USPC ..... 327/540; 327/538

(58) Field of Classification Search
None
See application file for complete search history.

(56) References Cited

U.S. PATENT DOCUMENTS

| | | | | | |
|---|---|---|---|---|---|
| 4,499,416 | A | * | 2/1985 | Koike | 323/303 |
| 4,727,309 | A | * | 2/1988 | Vajdic et al. | 323/315 |
| 4,749,877 | A | * | 6/1988 | Asazawa et al. | 327/541 |
| 4,825,145 | A | * | 4/1989 | Tanaka et al. | 323/315 |
| 4,868,416 | A | * | 9/1989 | Fitzpatrick et al. | 327/541 |
| 4,918,336 | A | * | 4/1990 | Graham et al. | 326/117 |
| 4,937,517 | A | * | 6/1990 | Kurashima | 323/315 |
| 5,166,553 | A | * | 11/1992 | Kotera et al. | 326/115 |
| 5,506,544 | A | * | 4/1996 | Staudinger et al. | 330/277 |
| 5,587,655 | A | * | 12/1996 | Oyabe et al. | 323/312 |
| 5,614,815 | A | * | 3/1997 | Yamagata et al. | 323/313 |
| 5,633,610 | A | * | 5/1997 | Maekawa et al. | 327/355 |
| 5,818,084 | A | * | 10/1998 | Williams et al. | 257/329 |
| 5,889,426 | A | * | 3/1999 | Kawakami et al. | 327/530 |
| 5,903,177 | A | * | 5/1999 | Schwab et al. | 327/308 |
| 6,114,901 | A | * | 9/2000 | Singh et al. | 327/543 |
| 6,275,100 | B1 | * | 8/2001 | Park et al. | 327/543 |
| 6,304,130 | B1 | * | 10/2001 | Poulin et al. | 327/430 |
| 6,515,538 | B2 | * | 2/2003 | Ono et al. | 327/541 |
| 6,606,001 | B1 | * | 8/2003 | Ziazadeh et al. | 330/288 |
| 6,639,452 | B2 | * | 10/2003 | Ono et al. | 327/541 |

(Continued)

FOREIGN PATENT DOCUMENTS

| | | | |
|---|---|---|---|
| JP | 50-118438 | A | 9/1975 |
| JP | 62-157920 | A | 7/1987 |

(Continued)

OTHER PUBLICATIONS

Office Action issued Feb. 5, 2013, in Japanese Patent Application No. 2011-023186 with English translation.

(Continued)

*Primary Examiner* — Thomas J Hiltunen
(74) *Attorney, Agent, or Firm* — Oblon, Spivak, McClelland, Maier & Neustadt, L.L.P.

(57) ABSTRACT

A reference-voltage generating circuit of an embodiment includes a first FET; a second FET; a first resistor in which one end is connected to a power supply while the other end is connected to a drain of the first FET; and a second resistor that is connected between the drain and a gate of the first FET, wherein a gate and a source of the second FET are connected, a drain of the second FET is connected to the gate of the first FET, the drain of the first FET outputs a reference voltage, and the source of the first FET and the source of the second FET are connected to a ground or another circuit.

18 Claims, 12 Drawing Sheets

(56) References Cited

U.S. PATENT DOCUMENTS

| | | | | |
|---|---|---|---|---|
| 6,639,453 | B2 * | 10/2003 | Nishimura et al. | 327/543 |
| 6,842,066 | B2 * | 1/2005 | Ishida et al. | 327/535 |
| 7,667,272 | B2 * | 2/2010 | Hirose | 257/360 |
| 7,902,917 | B2 * | 3/2011 | Mirzaei et al. | 327/558 |
| 2009/0230406 | A1 * | 9/2009 | Ellison et al. | 257/77 |

FOREIGN PATENT DOCUMENTS

| | | | |
|---|---|---|---|
| JP | 63-221414 | | 9/1988 |
| JP | 1-205309 | A | 8/1989 |
| JP | 4-349513 | A | 12/1992 |
| JP | 07-194099 | | 7/1995 |
| JP | 10-116129 | A | 5/1998 |
| JP | 2000-284842 | A | 10/2000 |
| JP | 2004-5048 | | 1/2004 |
| JP | 2005-47228 | | 2/2005 |
| JP | 2009-16980 | | 1/2009 |
| JP | 2010-67031 | | 3/2010 |

OTHER PUBLICATIONS

Office Action issued Oct. 8, 2013, in Japanese Patent Application No. 2011-023186, filed Feb. 4, 2011 (with Englishlanguage Translation).

* cited by examiner

CONSTANT-VOLTAGE CIRCUIT AND SEMICONDUCTOR DEVICE THEREOF

CROSS-REFERENCE TO RELATED APPLICATION

This application is based upon and claims the benefit of priority from Japanese Patent Applications No. 2011-023186, filed on Feb. 4, 2011; the entire contents of which are incorporated herein by reference.

FIELD

Embodiments described herein relate generally to a constant-voltage circuit and a semiconductor device thereof.

BACKGROUND

Unfortunately some electronic components cannot deal with speed enhancement of a wideband gap semiconductor under present circumstances. One of the electronic components is a Zener diode. The Zener diode starts to pass a current when a predetermined voltage or more is applied in a reverse direction, and a voltage at both ends of the Zener diode is kept constant. Therefore, the Zener diode is used for various purposes such as gate protection of a reference-voltage generating circuit and an FET and removal of a surge mixed from a power supply line.

However, in the Zener diode, a reference voltage changes by a current passed therethrough. This means that, when the Zener diode is connected to a power source containing a ripple, the current passed through the Zener diode changes by a power fluctuation and therefore the reference voltage fluctuates. In the case where an impedance of a load connected to an output of the reference voltage changes by the Zener diode, the output of the reference voltage becomes unstable because the current passed through the Zener diode changes. Because the reference voltage is generated by an avalanche breakdown, sometimes a large noise becomes troublesome. The Zener diode is mainly made of a Si semiconductor, and the high-speed operation of the Zener diode cannot be performed by factors such as a junction capacitance and slow hole mobility generated by a PN junction.

DETAILED DESCRIPTION

A constant-voltage circuit of an embodiment includes a first PET; a second FET; a first resistor in which one end is connected to a power supply while the other end is connected to a drain of the first FET; and a second resistor that is connected between the drain and a gate of the first FET, wherein a gate and a source of the second FET are connected, a drain of the second FET is connected to the gate of the first PET, the drain of the first FET outputs a reference voltage, and the source of the first FET and the source of the second PET are connected to a ground or another circuit.

Embodiments of the invention will be described below with reference to the drawings.

Hereinafter, embodiments will be described with reference to the drawings.

First Embodiment

Figure 1:
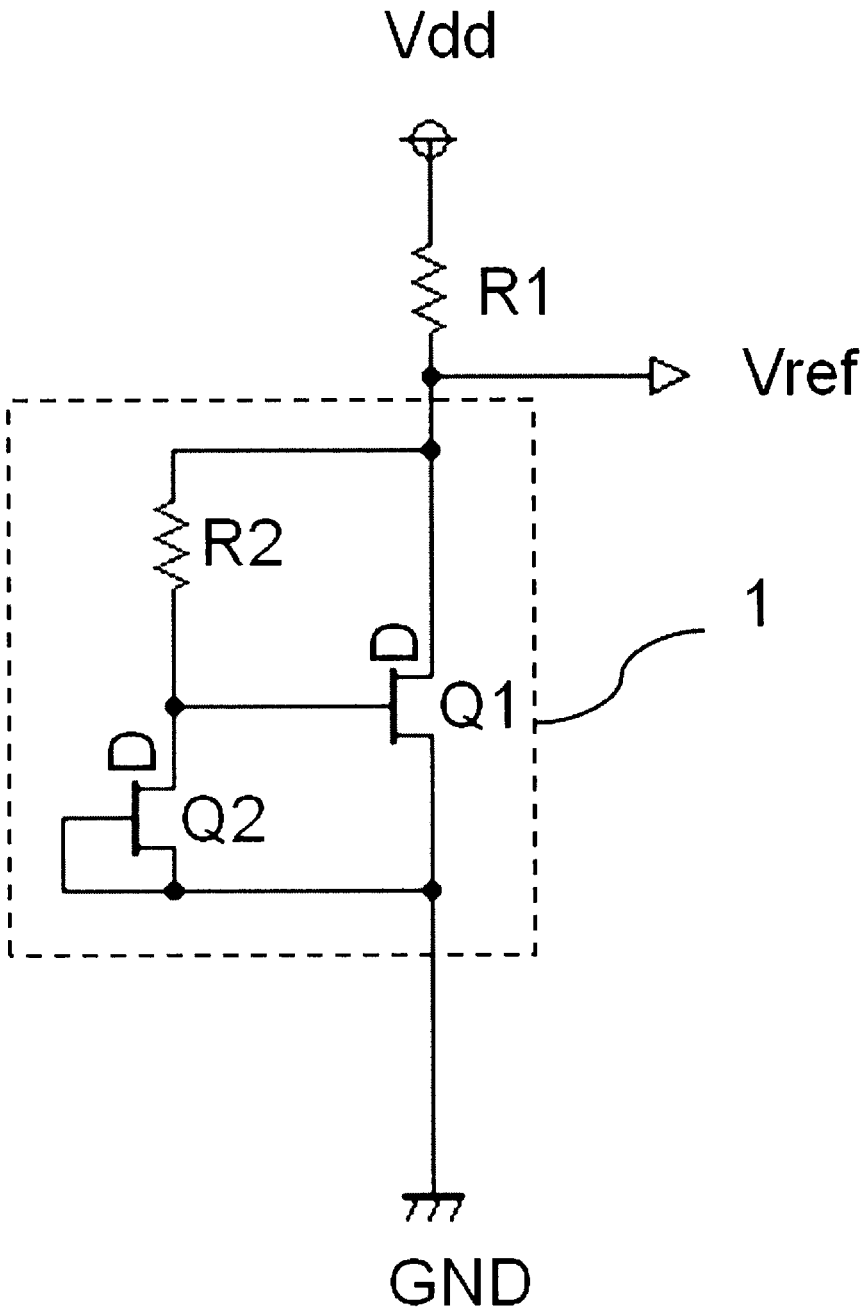
FIG. 1 is a circuit diagram of a reference-voltage generating circuit according to a first embodiment.

FIG. 1 illustrates a reference-voltage generating circuit 1 that outputs a predetermined reference voltage Vref from a power supply voltage Vdd. The reference-voltage generating circuit 1 of FIG. 1 includes: a first FET Q1; a second FET Q2; a first resistor R1 in which one end is connected to a power supply Vdd while the other end is connected to a drain of the first FET Q1; and a second resistor R2 that is connected between the drain and a gate of the first PET Q1, wherein a gate and a source of the second FET Q2 are connected, a drain of the second FET Q2 is connected to the gate of the first FET Q1, the drain of the first FET Q1 outputs a reference voltage Vref, and the source of the first FET Q1 and the source of the second FET Q2 are connected to a ground or another circuit. In the reference-voltage generating circuit 1, an enhancement type FET is preferably used as the first FET Q1. The depression type FET is used as the second FET Q2 of the reference-voltage generating circuit 1. However, because the second FET Q2 is intended to perform a constant-current operation, there is no particular limitation to the second FET Q2 as long as an element having a function equivalent to that of the depression type FET is used as the second FET Q2. The second resistor R2 is connected to the drain of the second FET Q2, and the other end of the second resistor R2 is connected to the drain of the first FET Q1. In FIG. 1, the sources of the first FET Q1 and the second FET Q2 are connected to a ground potential for the sake of convenience. Actually, it is not necessary that the sources of the first FET Q1 and the second FET Q2 are connected to the ground potential, but the sources of the first VET Q1 and the second FET Q2 may separately be connected to different potentials (other circuits). The first resistor R1 is connected to the power supply voltage Vdd and the drain of the first FET Q1.

Thus, the reference-voltage generating circuit 1 illustrated in FIG. 1 includes the second FET Q2 that constitutes a constant-current circuit, the second resistor R2 that acts as a current path to the constant-current circuit and a feedback resistance feeding back the reference voltage, the first resistor R1 that acts as a current limiter, and the first PET Q1 that outputs the reference voltage.

Figure 2:
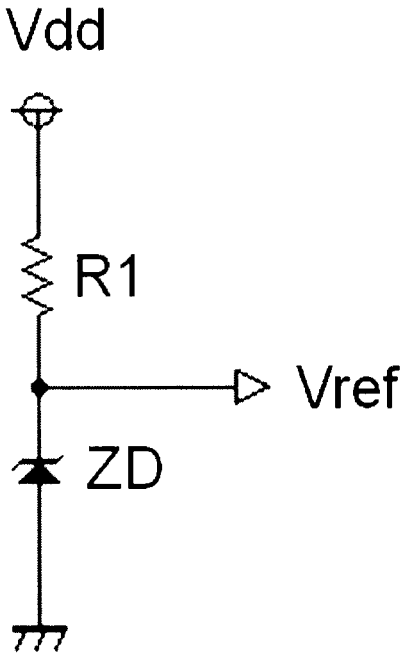
Related Art FIG. 2
FIG. 2 is a reference diagram illustrating a general method for using a Zener diode.

A general method for using the Zener diode of the related art will briefly be described before operations of the constituents are described in detail. FIG. 2 is a reference diagram illustrating the general method for using the Zener diode. The circuit includes a Zener diode ZD1 and a resistor R1. When a predetermined voltage or more is applied to the Zener diode ZD1 in the reverse direction, the avalanche breakdown is generated by the PN junction, and the Zener diode ZD1 rapidly passes the current. At this point, when the Zener diode ZD1 is connected to the power supply Vdd having a small impedance, the Zener diode ZD1 is burnt out due to the excess current. Therefore, the resistor R1 is inserted in series to increase the impedance of the power supply Vdd when the power supply Vdd is viewed from the Zener diode ZD1. When the predetermined voltage or more is applied, even if the current is passed, a voltage drop is generated by the resistor R1, and the predetermined voltage or more is not applied to the Zener diode ZD1. In other words, the current passed through the Zener diode ZD1 is limited by the resistor R1. Therefore, the constant voltage can be output by the Zener diode ZD1 and the resistor R1. The first resistor R1 in FIG. 1 that is the circuit diagram of the first embodiment has the same effect as the first resistors R1 illustrated in the circuit diagrams from FIG. 5. That is, the first resistor R1 limits the current with respect to the first FET Q1 that outputs the reference voltage.

Figure 3:
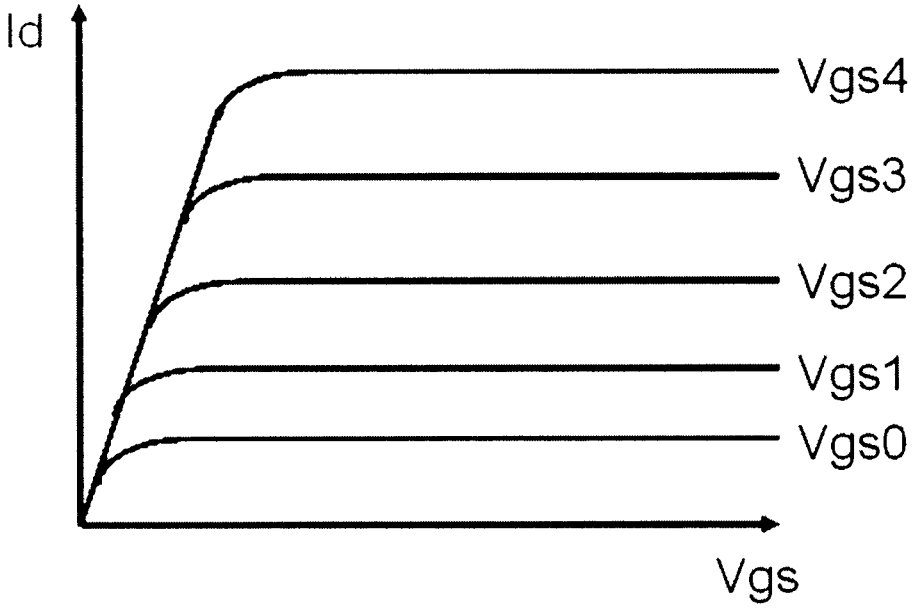
FIG. 3 is a view illustrating a relationship between a drain current and a gate-source voltage in an FET.

The constant-current operation of the second FET Q2 will be described below. It is assumed that the depression type FET is used as the second FET Q2. FIG. 3 is a view illustrating a relationship between a drain current Id and a gate-source voltage Vgs in an N-channel FET. A relationship of Vgs>Vgs3>Vgs2>Vgs1>Vgs1 holds in the gate-source voltage Vgs of FIG. 3. In the case where attention is paid to a certain gate-source voltage Vgs, the drain current Id is kept constant when a drain-source voltage Vds becomes a certain voltage or more. A region where the drain current Id is kept constant is referred to as a saturated region.

Figure 4:
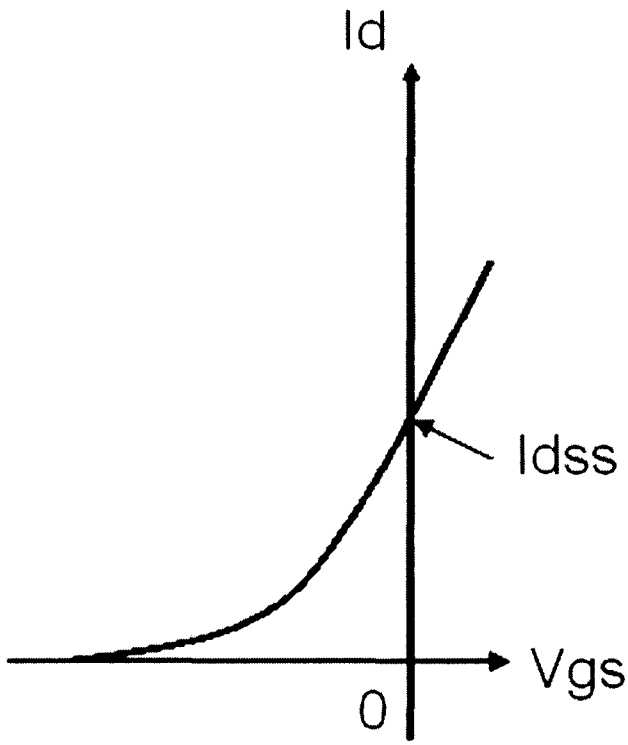
FIG. 4 is a view illustrating a relationship between a drain current and a gate-source voltage in an depression type FET.

FIG. 4 illustrates a relationship between the drain current Id and the gate-source voltage Vgs when the drain-source voltage Vds of the depression type FET is set such that an FET operation is performed in the saturated region. In the saturated region, the drain current Id depends on the value of the gate-source voltage Vgs irrespective of the drain-source voltage Vds. For example, in the case of Vgs=0 V, a unique current value Idss of FIG. 4 is passed through the FET. Therefore, when the gate-source voltage Vgs is fixed, the constant-current operation is achieved in the saturated region. In the second FET Q2 of FIG. 1, the gate and the source are connected to obtain the state of Vgs=0 V using the constant-current operation of FIG. 4, thereby forming a constant-current source. Because the first FET Q1 has a significantly large input impedance, the current generated by the second FET Q2 is substantially passed through the second resistor R2. It is assumed that I2 is the current that is substantially passed through the second resistor R2. The current I2 is kept constant, and the voltage applied to the second resistor R2 becomes I2×R2.

It is assumed that Vth(Q1) is a threshold voltage of the first FET Q1 and I1 is a current passed through the first FET Q1. Although the reference output voltage eventually becomes Vref=R2×I2+Vth(Q1), it is assumed that the drain voltage of the first FET Q1 is higher than the reference voltage Vref for some reason. At this point, it is assumed that +ΔV is an error. Because the current I2 is kept constant, the voltage drop of the second resistor R2 remains at R2×I2. Therefore, the gate-source voltage Vgs of the first FET Q1 is increased by +ΔV. The current I1 passed through the first FET Q1 is increased with increasing gate-source voltage Vgs. It is assumed that gm1 is a mutual conductance of the first FET Q1. Because the current I1 tends to be increased by ΔV×gm1 when the gate-source voltage Vgs is increased by +ΔV, the voltage drop of ΔV×gm1 is generated at the first resistor R1, which acts in a direction in which the drain voltage of the first FET Q1 is decreased. This means that the voltage drop of ΔV×gm1 acts in the direction in which the error of +ΔV initially generated for some reason is cancelled. On the contrary, it is assumed that the drain voltage of the first FET Q1 is lower than the reference voltage Vref for some reason. At this point, it is assumed that −ΔV is an error.

For the same reason, the gate voltage of the first FET Q1 is decreased by −ΔV, and the current I1 is decreased by ΔV×gm1. Because the voltage drop at the first resistor R1 is decreased by ΔV×gm1, which acts in the direction in which the drain voltage of the first FET Q1 is decreased. This means that the voltage drop of ΔV×gm1 acts in the direction in which the error of ΔV initially generated for some reason is cancelled. As described above, when the voltage except the reference voltage Vref is obtained, because the voltage drop cancels the error ΔV, the resultant reference voltage is given by Vref=R2×I2+Vth(Q1) from the balance. That is, the second resistor R2 acts as the feedback resistance in an amplifier, and a negative feedback is formed. Therefore, even if the impedance of the load connected to the drain of the first FET Q1 changes, the predetermined reference voltage can stably be output. The second resistor R2, the current I2, and the threshold voltage Vth(Q1), which are determination factors of the reference voltage Vref, can be determined by fixed values or design values. Therefore, the reference voltage Vref can freely be determined by a designer. The equation of Vref=R2×I2+Vth(Q1) does not include a term of power supply voltage Vdd. This means that the predetermined reference voltage can stably be output even if the power supply voltage Vdd of the power supply has a ripple. In the reference-voltage generating circuit 1 of FIG. 1, the predetermined reference voltage can stably be output, even if the impedance of the load connected to the drain of the first FET Q1 changes due to the unstable power supply voltage Vdd. The reference-voltage generating circuit 1 of FIG. 1 has a low noise because the avalanche breakdown caused by the PN junction is not performed, and the reference-voltage generating circuit 1 can be operated at high speed because only electrons having excellent mobility are used as a carrier of the semiconductor.

Basically the first resistor R1 is not an element that determines the output of the reference voltage. However, power consumption of the reference-voltage generating circuit is increased when the first resistor R1 has an excessively small resistance value. On the other hand, when the first resistor R1 has an excessively large resistance value, because the second FET Q2 cannot be operated in the saturated region, the current I2 is not kept constant, and the current corresponding to the change in impedance of the load connected to the drain of the first FET Q1 is not discharged, whereby possibly the output of the reference voltage becomes unstable. Therefore, the resistance value of the first resistor R1 should be determined such that R1≤(Vdd−Vref)/I2 holds.

Second Embodiment

Figure 5:
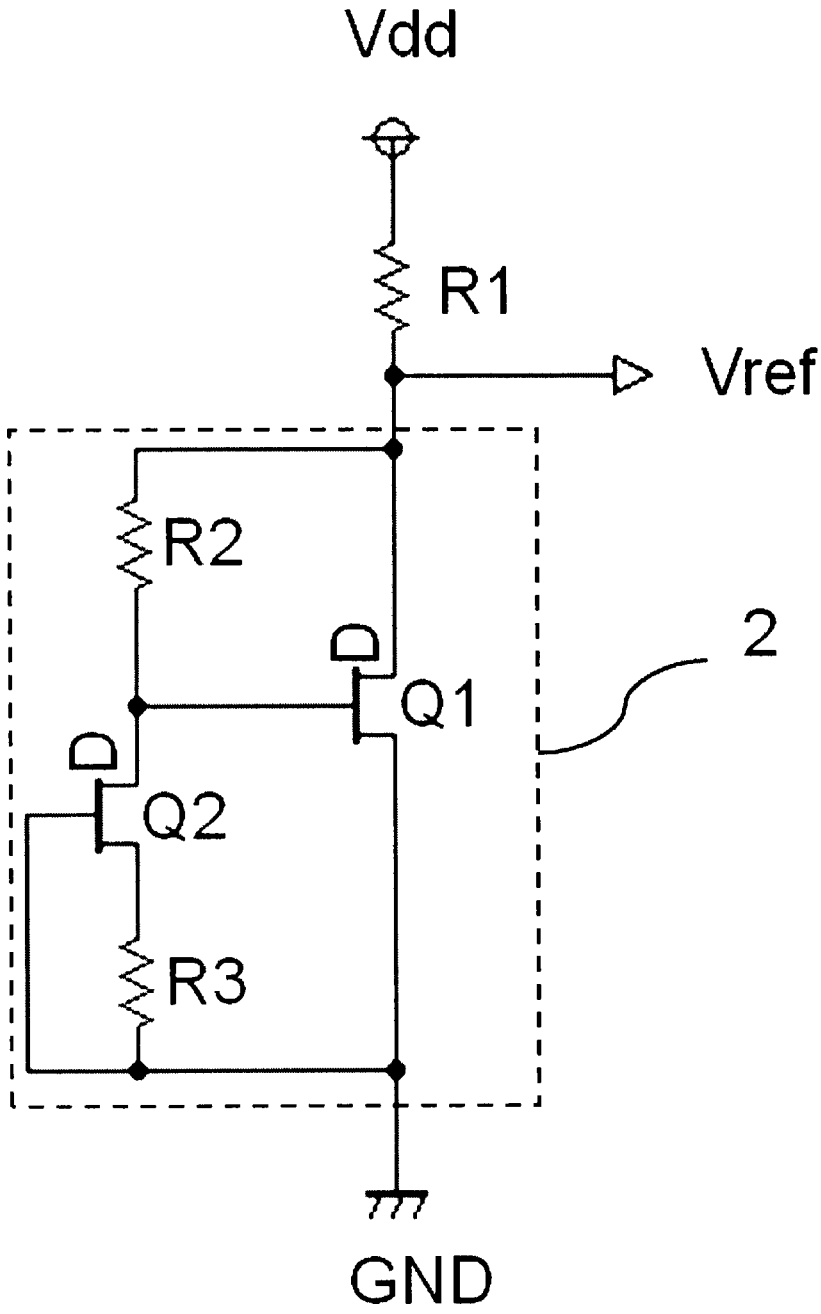
FIG. 5 is a circuit diagram of a reference-voltage generating circuit according to a second embodiment.

As illustrated in FIG. 5, in addition to the reference-voltage generating circuit 1 of the first embodiment, a reference-voltage generating circuit 2 according to a second embodiment further includes a third resistor R3 that is connected between the gate and the source of the second FET Q2 and between the source of the first FET Q1 and the source of the second FET Q2. The reference-voltage generating circuit 2 is configured such that the drain current of the second FET Q2 is passed through the third resistor R3. The third resistor R3 is not necessarily inserted only in the reference-voltage generating circuit 1 of the first embodiment, but the third resistor R3 may be inserted in reference-voltage generating circuits of other embodiments and modifications thereof.

At this point, because generally the resistor has a positive temperature coefficient, the resistance value of the second resistor R2 is increased when an environmental temperature of the reference-voltage generating circuit rises. Therefore, a temperature drift is possibly generated in the reference voltage Vref. In the first FET Q1, as the environmental temperature rises, the threshold voltage is increased, and the reference voltage Vref is increased higher than a predetermined voltage. However, because generally the FET has a negative temperature characteristic with respect to the current, the current passed through the FET is decreased when the temperature rises. Therefore, in the second FET Q2, the current is decreased as the temperature rises. This causes the temperature drift in the reference voltage Vref. However, the temperature drift caused by the second FET Q2 cancels the temperature drifts caused by the second resistor R2 and the first FET Q1. Therefore, the temperature drift of the reference voltage Vref can be suppressed when the reference-voltage generating circuit of second to sixth embodiments and modifications thereof are configured such that the temperature characteristics of the second resistor R2, the first PET Q1, and the second FET Q2 cancel one another.

A basic operating principle is similar to that of the first embodiment. When the third resistor R3 is inserted, the constant-current value generated by the second FET Q2 using the value of the third resistor R3 can freely change. When the current is passed through the third resistor R3, the gate-source voltage Vgs is considered to be a negative voltage when viewed from the second FET Q2. As can be seen from FIG. 4, a low current value can be set lower than the unique current value Idss. As a result, electric power saving can be achieved in the whole of the reference-voltage generating circuit. Because generally the resistor has the positive temperature coefficient, the resistance value of the third resistor R3 is increased when the environmental temperature of the reference-voltage generating circuit rises. Therefore, the gate-source voltage Vgs is shifted toward a negative side to decrease the constant-current value. This means that the reference voltage Vref becomes small. However, when the environmental temperature rises, the resistance value of the second resistor R2 is increased, which acts in the direction in which the reference voltage Vref becomes large. In the first FET Q1, as the environmental temperature rises, the threshold voltage is increased, and the reference voltage Vref is increased higher than a predetermined voltage. Because the temperature coefficients of the first FET Q1, the second resistor R2, and the third resistor R3 cancel one another, the temperature drift of the reference voltage Vref can be suppressed.

Third Embodiment

Figure 6:
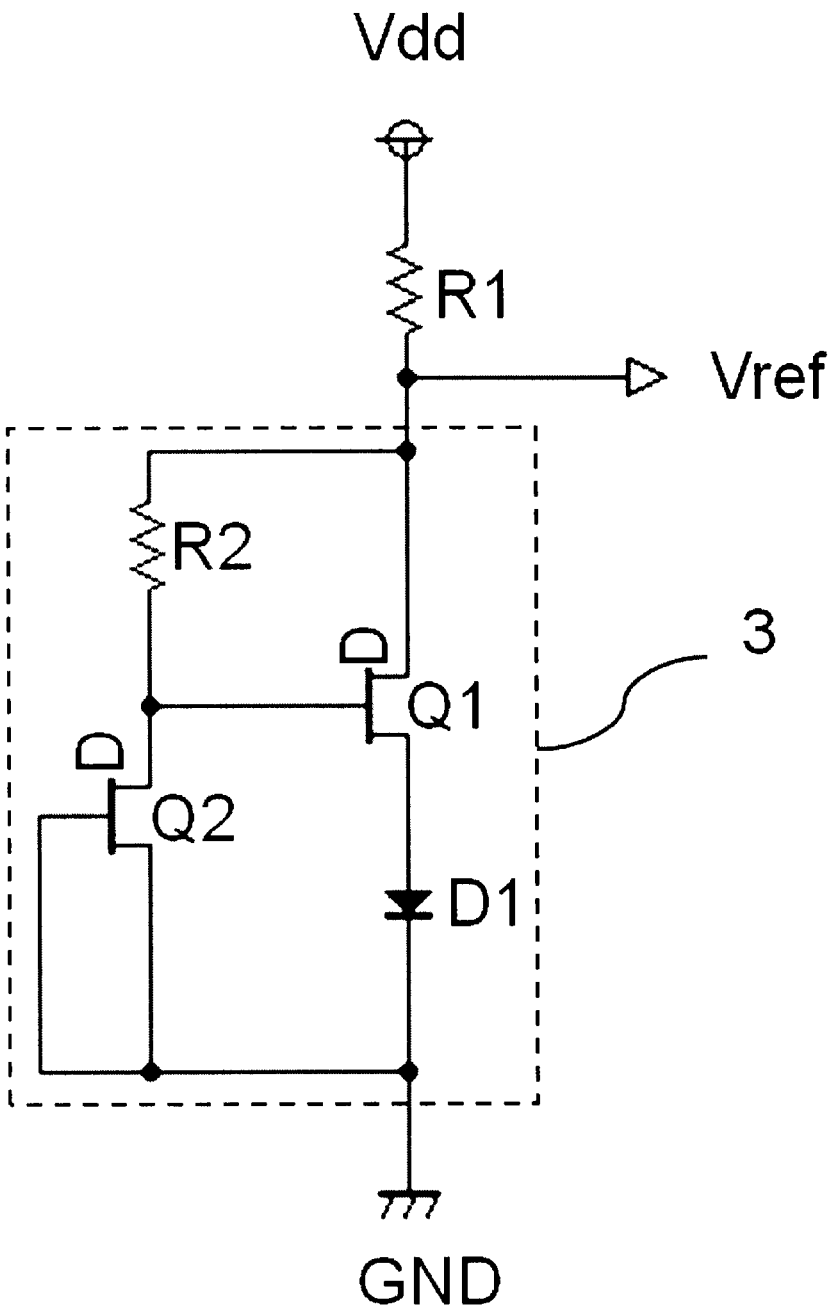
FIG. 6 is a circuit diagram of a reference-voltage generating circuit according to a third embodiment.

As illustrated in FIG. 6, in addition to the reference-voltage generating circuit 1 of the first embodiment, a reference-voltage generating circuit 3 according to a third embodiment further includes a first diode D1 in which an anode is connected to the source of the first FET Q1 while a cathode is connected to the ground or another circuit. The reference-voltage generating circuit 3 is configured such that the drain current of the first FET Q1 is passed through the first diode D1. The first diode D1 is not necessarily inserted only in the reference-voltage generating circuit 1 of the first embodiment, but the first diode D1 may be inserted in reference-voltage generating circuits of other embodiments and modifications thereof.

A basic operating principle is similar to that of the first embodiment. As described above, as the environmental temperature rises, the resistance value of the second resistor R2 is increased, whereby the reference voltage Vref rises higher than the predetermined voltage. In the first FET Q1, as the environmental temperature rises, the threshold voltage is increased, and the reference voltage Vref is increased higher than a predetermined voltage. The first diode D1 is inserted in order to cancel the temperature coefficients of the first FET Q1 and the second resistor R2. Generally a forward voltage of the diode is decreased as the temperature rises. As a result, because the gate-source voltage Vgs of the first FET Q1 is equivalent to the temperature rise, the drain current of the first FET Q1 is increased, and the drain voltage of the first FET Q1 is decreased. The temperature drift of the reference voltage Vref can be suppressed when the increase in reference voltage Vref caused by the second resistor R2 and the first FET Q1 according to the environmental temperature rise cancels the effect of the decrease in drain voltage of the first FET Q1 caused by the decrease in forward voltage of the first diode D1. Desirably a Schottky barrier diode (SBD) is used as the first diode D1 from the viewpoints of the high-speed operation and the parasitic capacitance. Alternatively, a PN-junction diode or a PIN diode may be used depending on the design and application.

Modification of Third Embodiment

Figure 7:
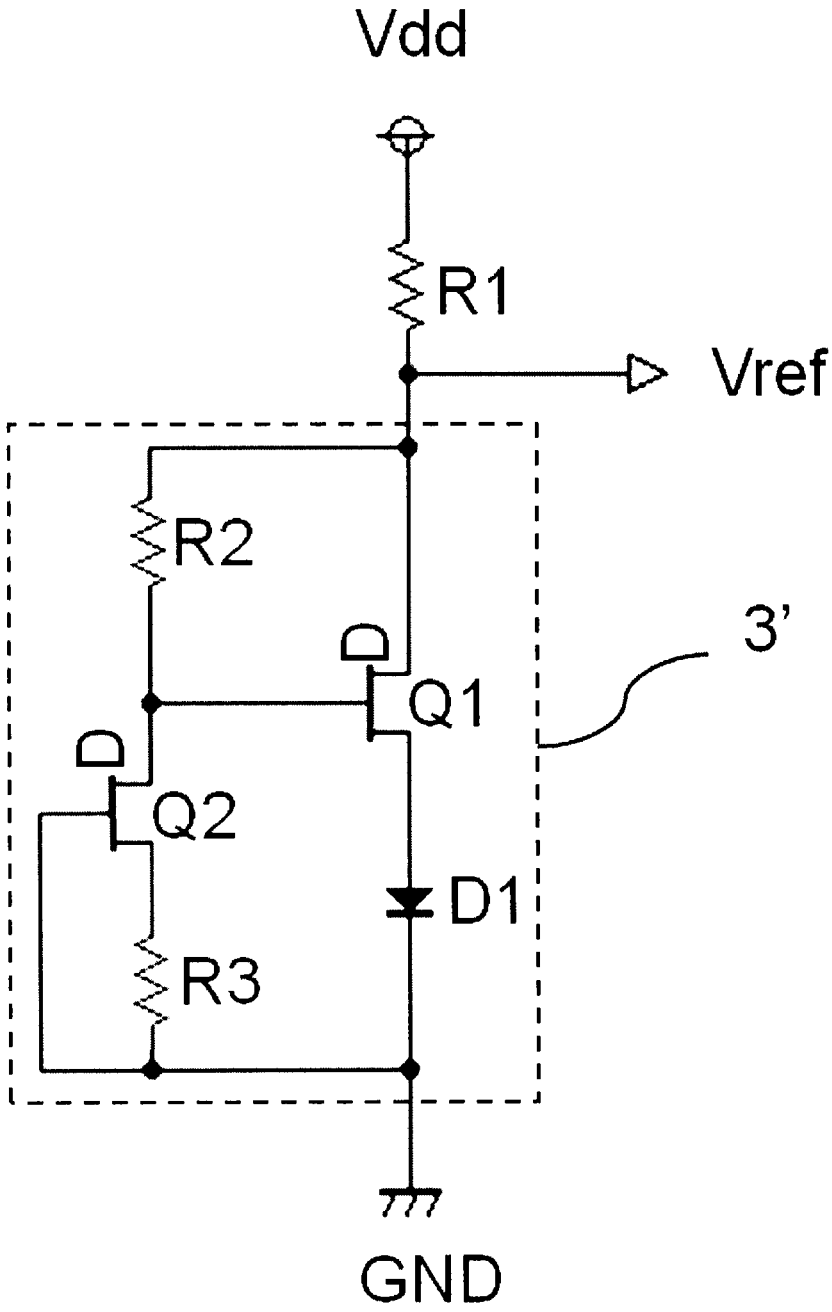
FIG. 7 is a circuit diagram of a reference-voltage generating circuit according to a modification of the third embodiment.

As illustrated in FIG. 7, in addition to the reference-voltage generating circuit 3 of the first embodiment, a reference-voltage generating circuit 3' according to a modification of the third embodiment further includes a third resistor R3 that is connected between the gate and the source of the second FET Q2 and between the source of the first FET Q1 and the source of the second FET Q2. The reference-voltage generating circuit 3' is configured such that the drain current of the second FET Q2 is passed through the third resistor R3. The temperature drift of the reference voltage Vref can further be suppressed by combining the second and third embodiments.

Fourth Embodiment

Figure 8:
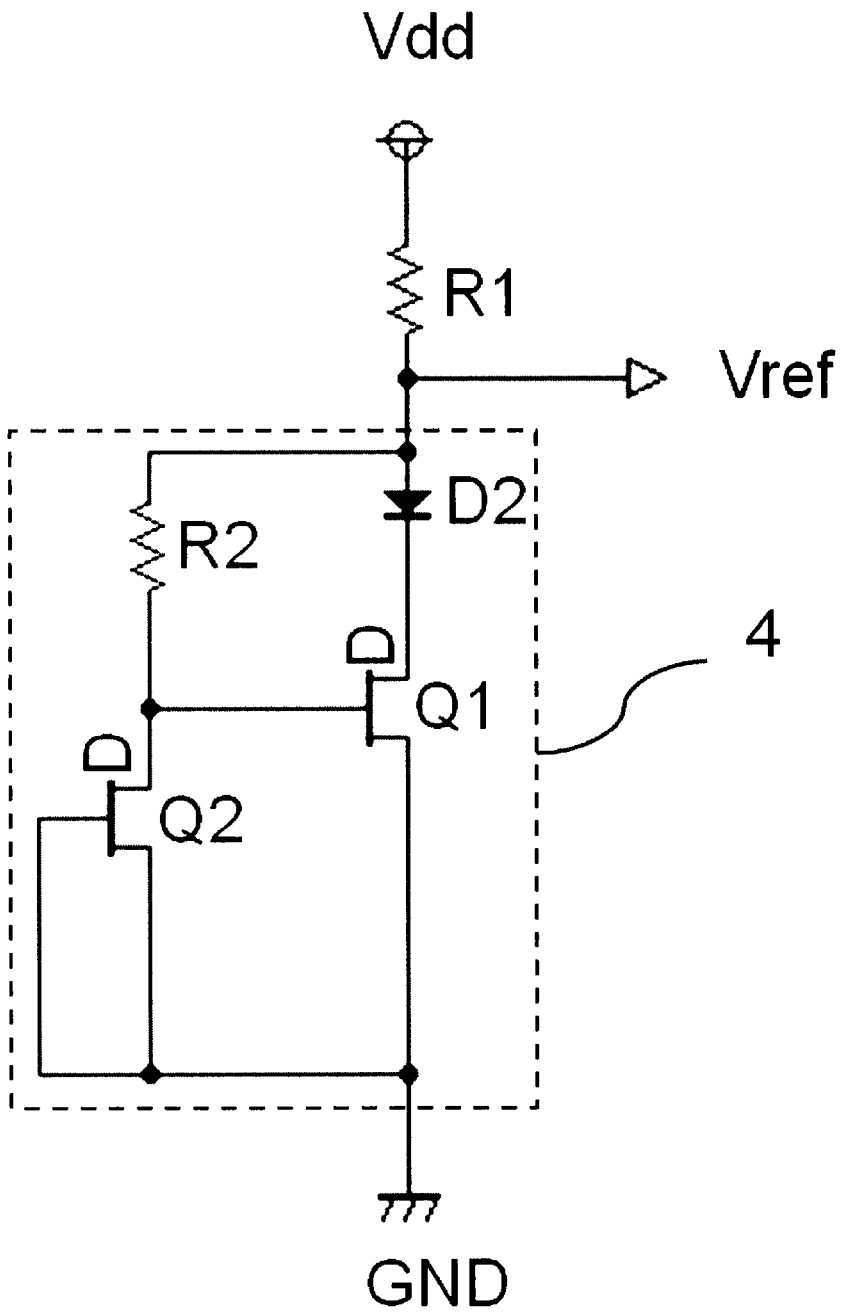
FIG. 8 is a circuit diagram of a reference-voltage generating circuit according to a fourth embodiment.

As illustrated in FIG. 8, in addition to the reference-voltage generating circuit 1 of the first embodiment, a reference-voltage generating circuit 4 according to a fourth embodiment further includes a second diode D2 in which a cathode is connected to the drain of the first FET Q1 while an anode is connected to the first resistor R1 and the second resistor R2. The reference-voltage generating circuit 4 is configured such that the drain current of the first FET Q1 is passed through the second diode D2. The second diode D2 is not necessarily inserted only in the reference-voltage generating circuit 1 of the first embodiment, but the second diode D2 may be inserted in reference-voltage generating circuits of other embodiments and modifications thereof.

A basic operating principle is similar to that of the first embodiment. As described above, as the environmental temperature rises, the resistance value of the second resistor R2 is increased, whereby the reference voltage Vref rises higher than the predetermined voltage. In the first FET Q1, as the environmental temperature rises, the threshold voltage is increased, and the reference voltage Vref is increased higher than a predetermined voltage. The second diode D2 is inserted in order to cancel the temperature coefficients of the first FET Q1 and the second resistor R2. Generally a forward voltage of the diode is decreased as the temperature rises. The temperature drift of the reference voltage Vref can be suppressed when the increase in reference voltage Vref caused by the second resistor R2 and the first FET Q1 due to the environmental temperature rise cancels the effect of the decrease in forward voltage of the second diode D2. Desirably the SBD is used as the second diode D2 from the viewpoints of the high-speed operation and the parasitic capacitance. Alternatively, the PN-junction diode or the PIN diode may be used depending on the design and application.

Modification of Fourth Embodiment

Figure 9:
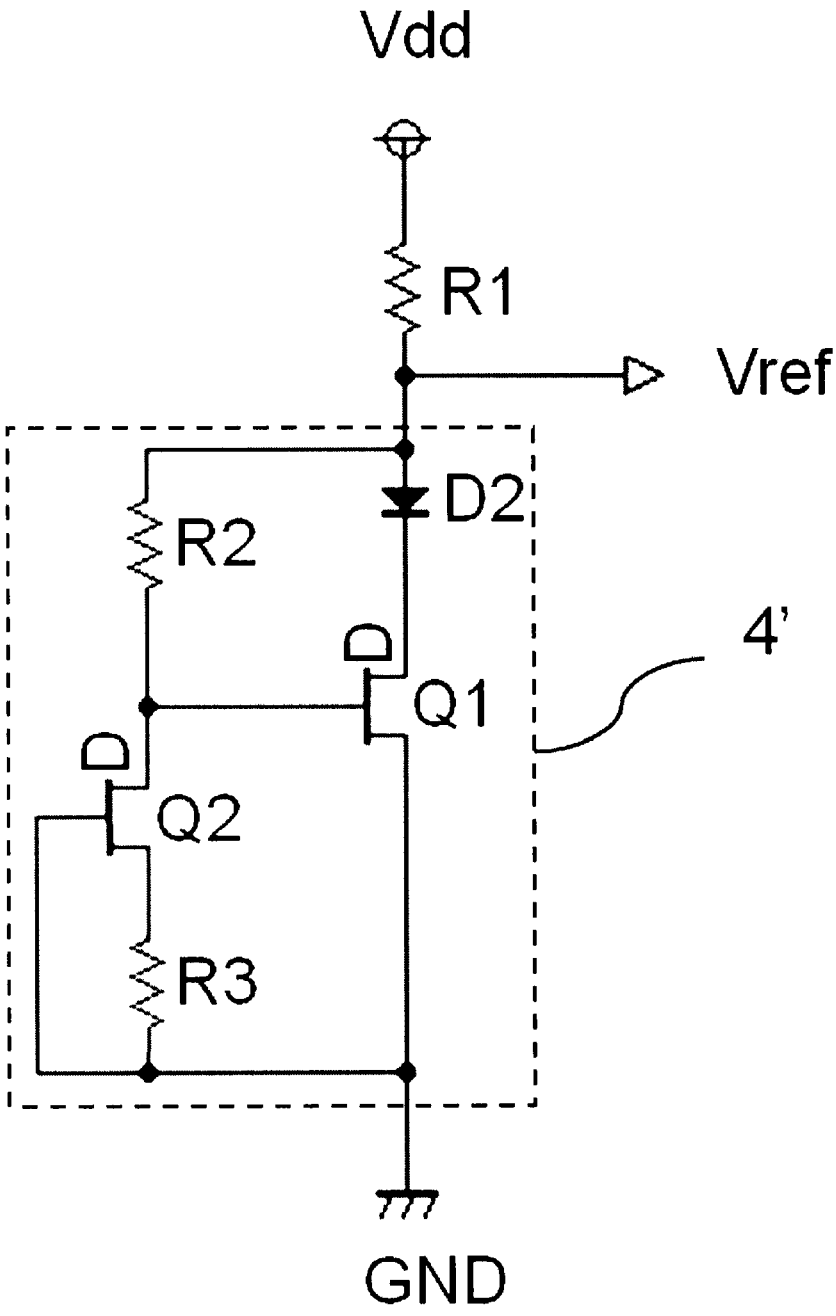
FIG. 9 is a circuit diagram of a reference-voltage generating circuit according to a modification of the fourth embodiment.

As illustrated in FIG. 9, in addition to the reference-voltage generating circuit 4 of the fourth embodiment, a reference-voltage generating circuit 4' according to a modification of the fourth embodiment further includes a third resistor R3 that is connected between the gate and the source of the second FET Q2 and between the source of the first FET Q1 and the source of the second FET Q2. The reference-voltage generating circuit 4' is configured such that the drain current of the second FET Q2 is passed through the third resistor R3. The temperature drift of the reference voltage Vref can further be suppressed by combining the second and fourth embodiments.

Fifth Embodiment

Figure 10:
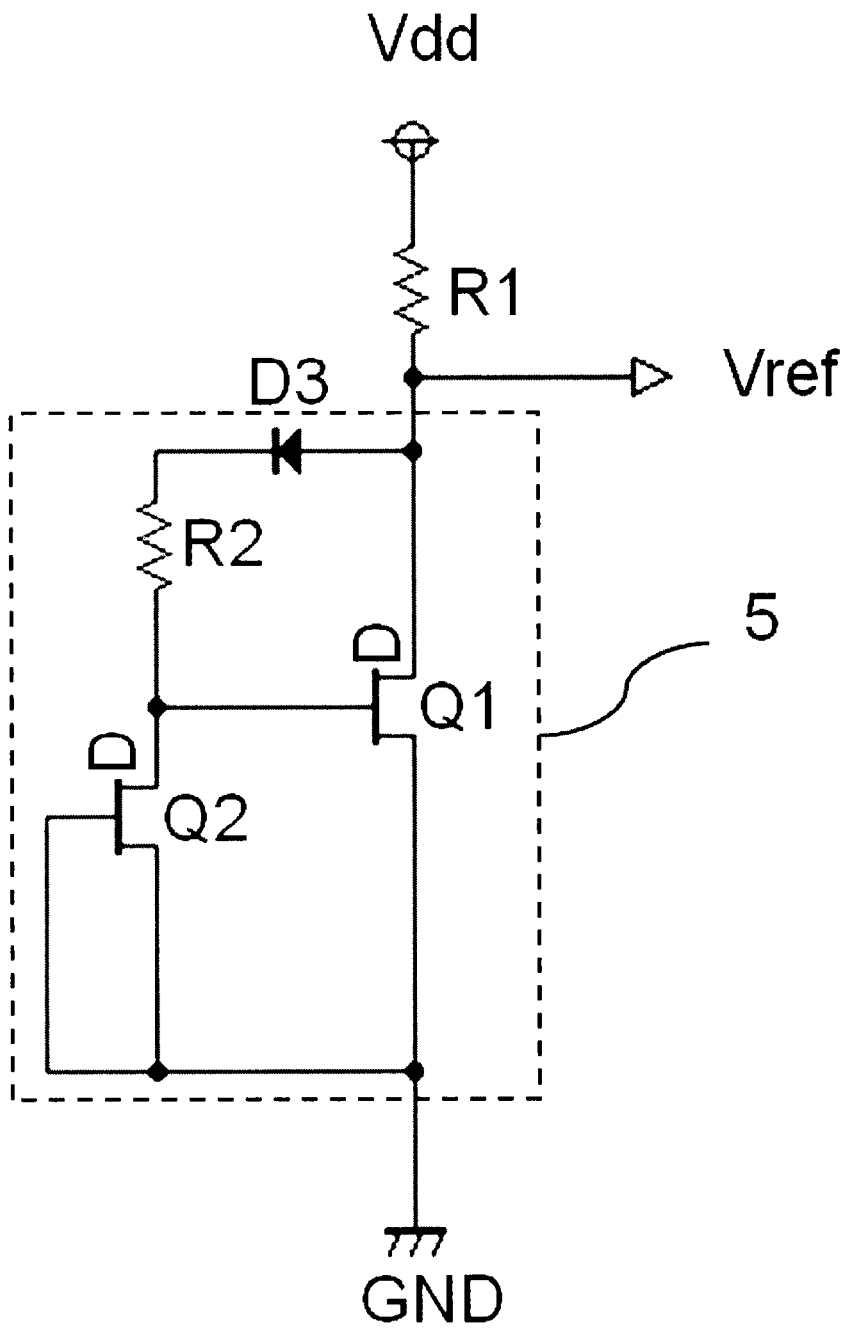
FIG. 10 is a circuit diagram of a reference-voltage generating circuit according to a fifth embodiment.

As illustrated in FIG. 10, in addition to the reference-voltage generating circuit 1 of the first embodiment, a reference-voltage generating circuit 5 according to a fifth embodiment further includes a third diode D3 in which an anode is connected to the drain of the first FET Q1 and the first resistor R1 while an cathode is connected to the second resistor R2. The reference-voltage generating circuit 5 is configured such that the drain current of the second FET Q2 is passed through the third diode D3. The third diode D3 is not necessarily inserted only in the reference-voltage generating circuit 1 of the first embodiment, but the third diode D3 may be inserted in reference-voltage generating circuits of other embodiments and modifications thereof. Because the second resistor R2 and the third diode D3 are connected in series, the second resistor R2 and the third diode D3 may reversely be connected as appropriate.

A basic operating principle is similar to that of the first embodiment. As described above, as the environmental temperature rises, the resistance value of the second resistor R2 is increased, whereby the reference voltage Vref may rise higher than the predetermined voltage. In the first FET Q1, as the environmental temperature rises, the threshold voltage is increased, and the reference voltage Vref is increased higher than a predetermined voltage. The third diode D3 is inserted in order to cancel the temperature coefficients of the first FET Q1 and the second resistor R2. Generally a forward voltage of the diode is decreased as the temperature rises. The temperature drift of the reference voltage Vref can be suppressed when the increase in reference voltage Vref caused by the second resistor R2 and the first FET Q1 due to the environmental temperature rise cancels the effect of the decrease in forward voltage of the third diode D3. Desirably the SBD is used as the third diode D3 from the viewpoints of the high-speed operation and the parasitic capacitance. Alternatively, the PN-junction diode or the PIN diode may be used depending on the design and application.

Modification of Fifth Embodiment

Figure 11:
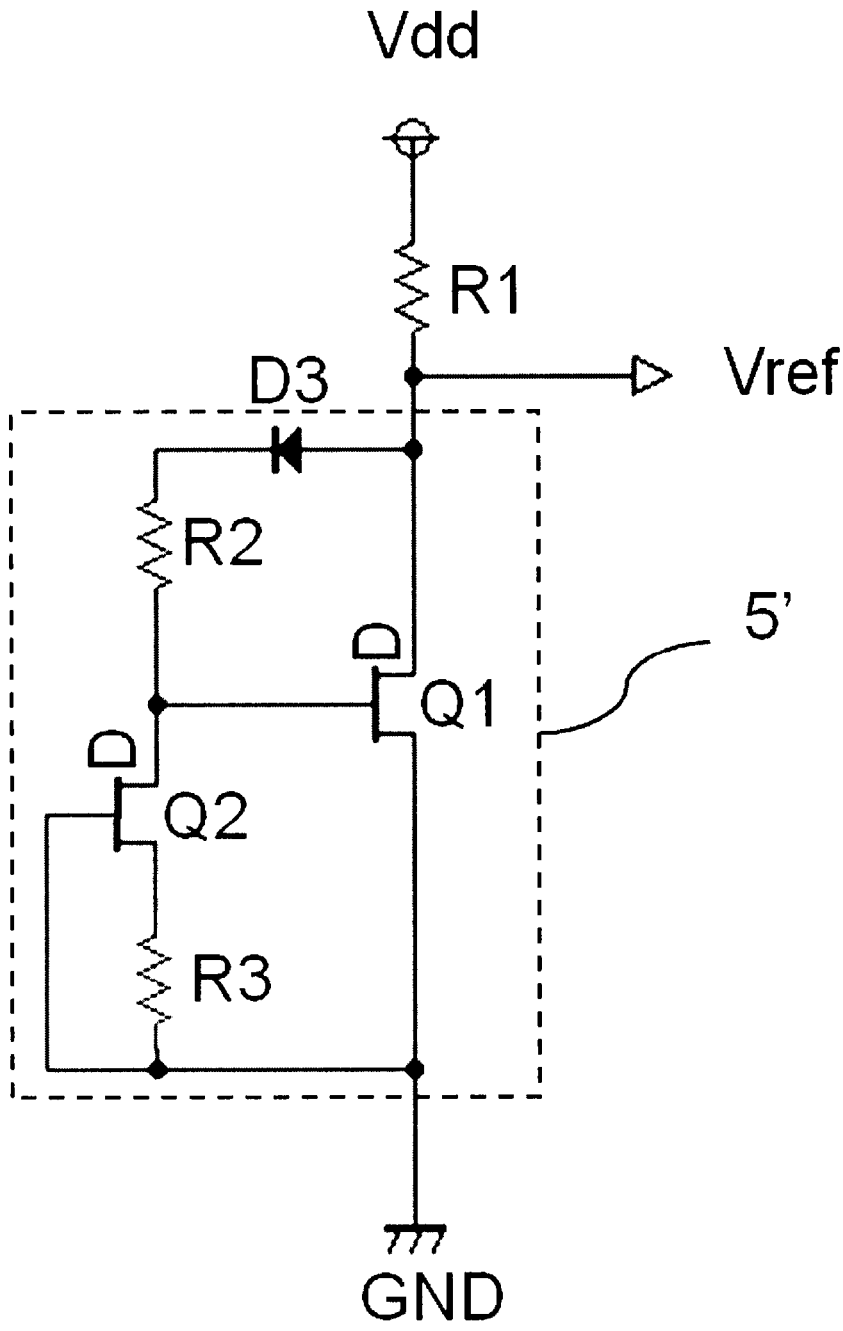
FIG. 11 is a circuit diagram of a reference-voltage generating circuit according to a modification of the fifth embodiment.

As illustrated in FIG. 11, in addition to the reference-voltage generating circuit 5 of the fifth embodiment, a reference-voltage generating circuit 5' according to a modification of the fifth embodiment further includes a third resistor R3 that is connected between the gate and the source of the second FET Q2 and between the source of the first FET Q1 and the source of the second FET Q2. The reference-voltage generating circuit 5' is configured such that the drain current of the second FET Q2 is passed through the third resistor R3. The temperature drift of the reference voltage Vref can further be suppressed by combining the second and fifth embodiments.

Sixth Embodiment

Figure 12:
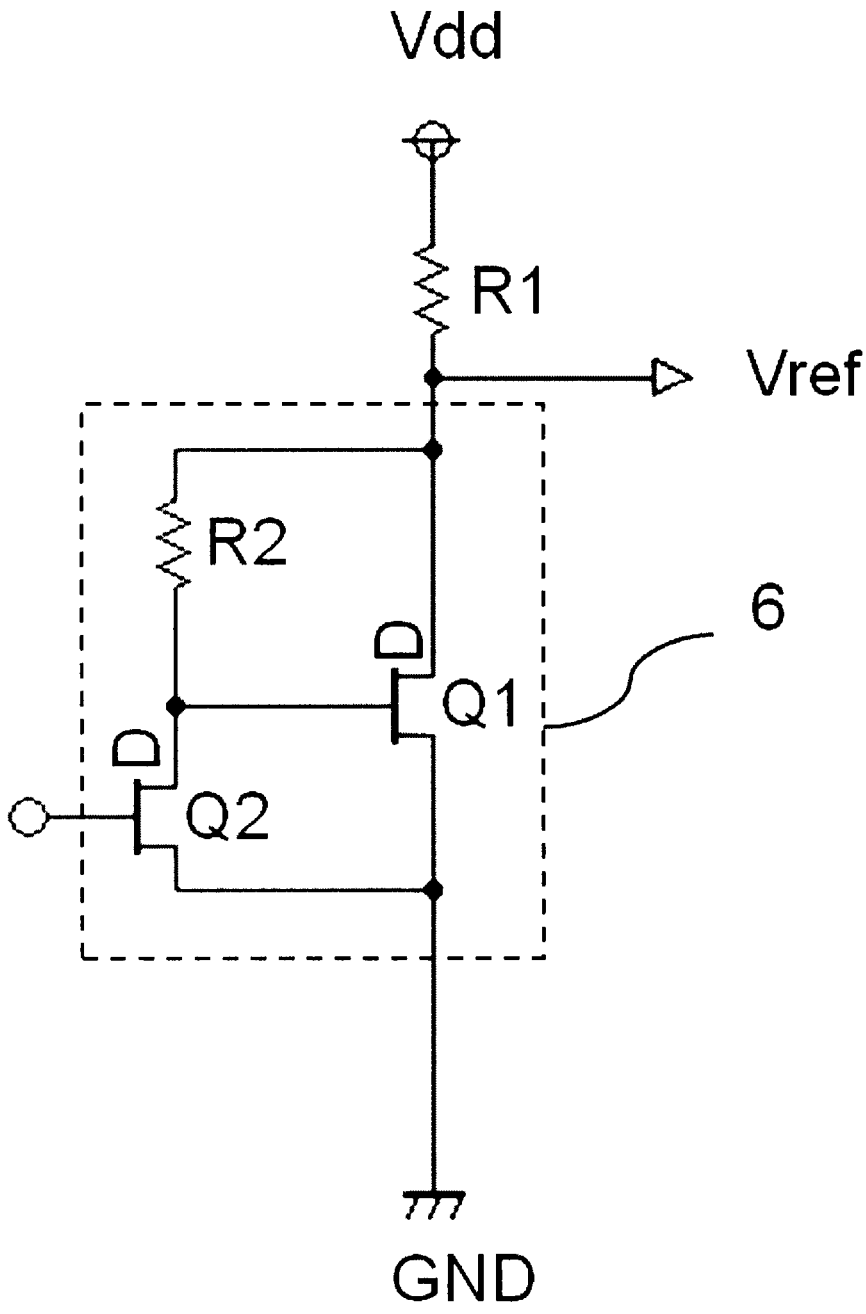
FIG. 12 is a circuit diagram of a reference-voltage generating circuit according to a sixth embodiment.

As illustrated in FIG. 12, in addition to the reference-voltage generating circuit 1 of the first embodiment, a reference-voltage generating circuit 6 according to a sixth embodiment further includes an external input terminal of the gate of the second FET Q2, and the gate and the source of the second FET Q2 are not connected. The sixth embodiment is not necessarily applied only to the first embodiment, but the circuit including the external input may be applied to reference-voltage generating circuits of other embodiments and modifications thereof. The second FET Q2 may be the depression type FET or the enhancement type FET.

A basic operating principle is similar to that of the first embodiment. However, the constant-current value of the second FET Q2 can freely change according to an external signal by switching the gate of the second FET Q2 to the external input, so that the predetermined reference voltage can be controlled by the external signal.

Modification of Sixth Embodiment

Figure 13:
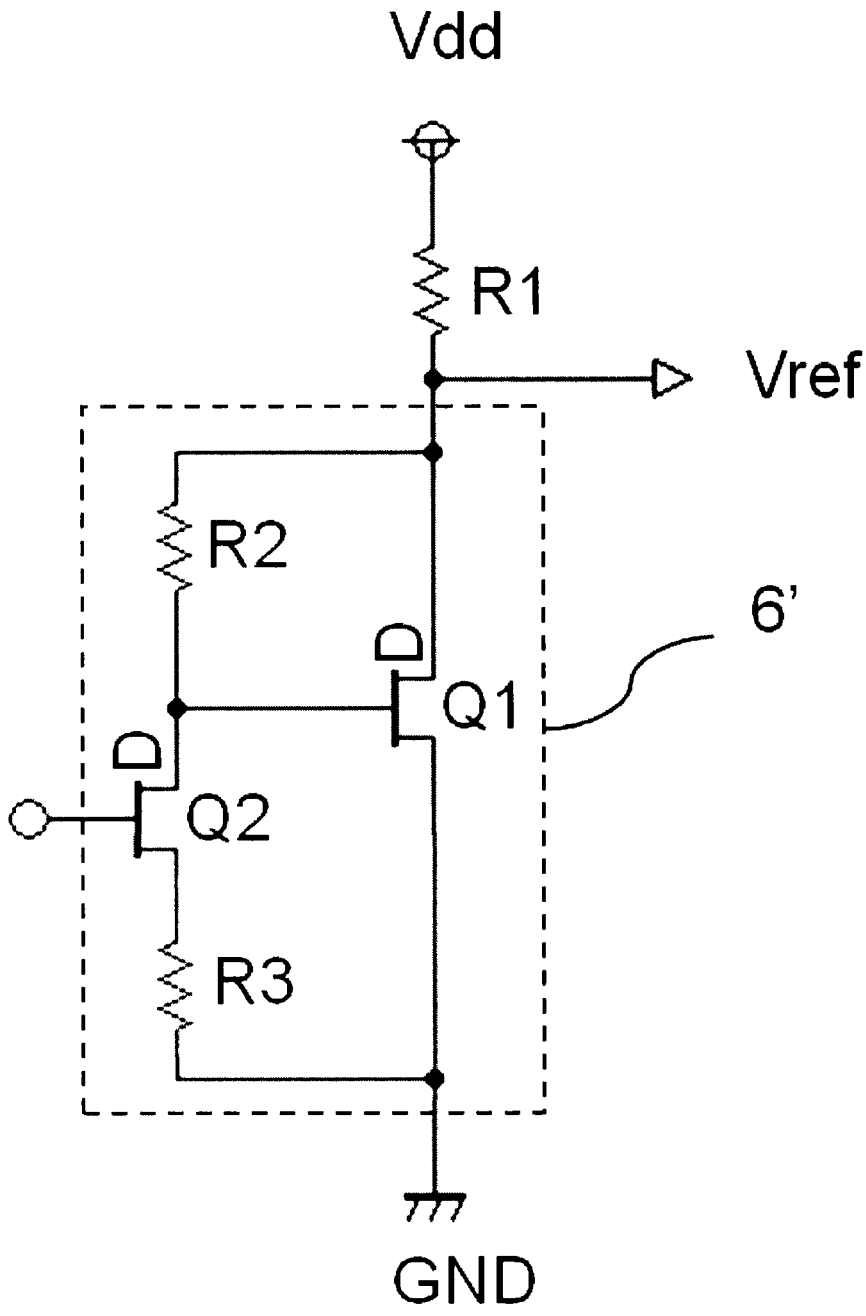
FIG. 13 is a circuit diagram of a reference-voltage generating circuit according to a modification of the sixth embodiment.

As illustrated in FIG. 13, in addition to the reference-voltage generating circuit 6 of the sixth embodiment, a reference-voltage generating circuit 6' according to a modification of the sixth embodiment further includes the third resistor R3 that is connected between the source of the second FET Q2 and the source of the first FET Q1 and between the source of the second FET Q2 and the ground or another circuit. The reference-voltage generating circuit 6' is configured such that the drain current of the second FET Q2 is passed through the third resistor R3. By combining the third resistor R3 of the second embodiment and the sixth embodiment, the predetermined reference voltage can be controlled by the external signal while the temperature drift of the reference voltage Vref is suppressed.

Seventh Embodiment

In a seventh embodiment, for example, as illustrated in FIGS. 1 and 5 to 11, on-chip of the circuit portion in which the first resistor R1 is removed in the first to fifth embodiments is formed on the same wafer. In FIGS. 1 and 5 to 11, the on-chip of dotted-line regions 1, 2, 3, 4, and 5 (3', 4', and 5') are achieved. Each of the dotted-line regions 1, 2, 3, 4, and 5 (3', 4', and 5') can be regarded as two-terminal structure by achieving the on-chip of the dotted-line regions 1, 2, 3, 4, and 5 (3', 4', and 5'). Because the dotted-line region has the same function as the Zener diode, the same method for using the Zener diode of the related art can be adopted. That is, the dotted-line region can be used in the same way as the Zener diode ZD1 of FIG. 2. Because the parasitic resistance, a parasitic inductance, and a parasitic capacitance can gradually be decreased by the on-chip, the reference-voltage generating circuits of the first to fifth embodiments are stably operated at high speed. The temperature drift is easily suppressed because the temperature coefficients of the components constituting the reference-voltage generating circuit can be equalized by producing the reference-voltage generating circuit on the same wafer. The first resistor R1 should properly be determined as the external circuit in a range of R1≤(Vdd−Vref)/I2 from the viewpoints of use conditions. The on-chip of the reference-voltage generating circuit including the first resistor R1 may be achieved, when a trouble with a power loss is not generated even if the on-chip of the reference-voltage generating circuit including the first resistor R1 is achieved.

Eighth Embodiment

In an eighth embodiment, for example, as illustrated in FIGS. 12 and 13, the on-chip of the circuit portion in which the first resistor R1 is removed in the sixth embodiment is achieved on the same wafer. In FIGS. 12 and 13, the on-chip of dotted-line region 6 (6') is achieved. The dotted-line region 6 (6') can be regarded as three-terminal structure by achieving the on-chip of the dotted-line region 6 (6'). Because the parasitic resistance, the parasitic inductance, and the parasitic capacitance can gradually be decreased by the on-chip, the reference-voltage generating circuit of the sixth embodiment is stably operated at high speed. The temperature drift is easily suppressed because the temperature coefficients of the components constituting the reference-voltage generating circuit can be equalized by producing the reference-voltage generating circuit on the same wafer. The first resistor R1 should properly be determined as the external circuit in a range of R1≤(Vdd−Vref)/I2 from the viewpoints of use conditions. The on-chip of the reference-voltage generating circuit including the first resistor R1 may be achieved, when a trouble with a power loss is not generated even if the on-chip of the reference-voltage generating circuit including the first resistor R1 is achieved.

Ninth Embodiment

In a ninth embodiment, wide bandgap semiconductors such as GaN, SiC, diamond, and ZnO are used as the semiconductor wafer used in the on-chip in the seventh or eighth embodiment.

Because the wide bandgap semiconductors have features such as a low on-resistance and a high withstanding voltage, advantageously the input capacitance of the FET can be decreased when the FET is produced. Therefore, the reference-voltage generating circuit of the embodiments can be operated at higher speed. The circuit having the same function as the Zener diode is useful because it is currently difficult to produce the Zener diode in which the high-speed operation can be performed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A reference-voltage generating circuit comprising:

a first FET;

a second FET;

a first resistor in which one end is connected to a power supply while the other end is connected to a drain of the first FET; and a second resistor that is connected between the drain and a gate of the first FET, wherein a gate and a source of the second FET are connected, a drain of the second FET is connected to the gate of the first FET, the drain of the first FET outputs a reference voltage between the other end of the first resistor and one end of the second resistor which is connected to the drain of the first FET and between the other end of the first resistor and the drain of the first FET, and the source of the first FET and the source of the second FET are connected to a ground or another circuit.

2. The circuit according to claim 1, further comprising a third resistor that is connected between the gate and the source of the second FET and between the source of the first FET and the source of the second FET.

3. The circuit according to claim 1, further comprising a first diode in which an anode is connected to the source of the first FET while a cathode is connected to the ground or the another circuit.

4. The circuit according to claim 1, further comprising a second diode in which a cathode is connected to the drain of the first FET while an anode is connected to the first resistor and the second resistor.

5. The circuit according to claim 1, further comprising a third diode in which an anode is connected to the drain of the first FET and the first resistor while a cathode is connected to the second resistor.

6. A semiconductor device comprising a reference-voltage generating circuit that includes:

a first FET;

a second FET; and a second resistor that is connected between a drain and a gate of the first FET, wherein a gate and a source of the second FET are connected, a drain of the second FET is connected to the gate of the first FET, the drain of the first FET outputs a reference voltage between one end of the second resistor which is connected to the drain of the first FET and the drain of the first FET, and the source of the first FET and the source of the second FET are connected to a ground or another circuit, on-chip of the reference-voltage generating circuit is implemented on a wafer, and the on-chip wafer comprises terminals comprising a terminal for outputting the reference voltage and a terminal for connecting to the ground or another circuit, the terminals are electrically connected to the reference-voltage generating circuit.

7. The device according to claim 6, further comprising a third resistor that is connected between the gate and the source of the second FET and between the source of the first FET and the source of the second FET.

8. The device according to claim 6, further comprising a first diode in which an anode is connected to the source of the first FET while a cathode is connected to the ground or the another circuit.

9. The device according to claim 6, further comprising a first resistor in the on-chip in which one end is connected to a power supply while the other end is connected to the drain of the first FET.

10. The device according to claim 9, further comprising a second diode in the on-chip in which a cathode is connected to the drain of the first FET while an anode is connected to the first resistor and the second resistor.

11. The device according to claim 9, further comprising a third diode in the on-chip in which an anode is connected to the drain of the first FET and the first resistor while a cathode is connected to the second resistor.

12. The device according to claim 6, wherein the wafer is made of a semiconductor selected from GaN, SiC, diamond, and ZnO.

13. The device according to claim 9, wherein the wafer is made of a semiconductor selected from GaN, SiC, diamond, and ZnO.

14. A reference-voltage generating circuit comprising:

a first FET;

a second FET;

a first resistor in which one end is connected to a power supply while the other end is connected to a drain of the first FET;

a second resistor that is connected between the drain and a gate of the first FET; and an external input terminal of the gate of the second FET, a drain of the second FET is connected to the gate of the first FET, wherein the drain of the first FET outputs a reference voltage between the other end of the first resistor and one end of the second resistor which is connected to the drain of the first FET and between the other end of the first resistor and the drain of the first FET, and the source of the first FET and the source of the second FET are connected to a ground or another circuit.

15. The circuit according to claim 14, further comprising:

an external input terminal of the gate of the second FET; and a third resistor that is connected between the source of the second FET and the source of the first FET and between the source of the second FET and the ground or the another circuit, wherein the source and the gate of the second FET are not connected.

16. A semiconductor device comprising a reference-voltage generating circuit that includes:

a first FET;

a second FET; and a second resistor that is connected between a drain and a gate of the first FET, wherein a drain of the second FET is connected to the gate of the first FET, the drain of the first FET outputs a reference voltage between one end of the second resistor which is connected to the drain of the first FET and the drain of the first FET, and the source of the first FET and the source of the second FET are connected to a ground or another circuit, on-chip of the reference-voltage generating circuit is implemented on a wafer, and the wafer comprises terminals comprising a terminal for outputting the reference voltage, a terminal for connecting to the ground or another circuit and an external input terminal of the gate of the second FET, the terminals are electrically connected to the reference-voltage generating circuit.

17. The device according to claim 16, further comprising a third resistor in the on-chip that is connected between the source of the second FET and the source of the first FET and between the source of the second FET and the ground or the another circuit.

18. The device according to claim 16, wherein the wafer is made of a semiconductor selected from GaN, SiC, diamond, and ZnO.

* * * * *